United States Patent [19]

Paul

[11] 4,111,741

[45] Sep. 5, 1978

[54] ARRANGEMENT FOR SHUTTING OFF THE DRIVE FOR A SUPPLY ROLL

[75] Inventor: Wolfgang Paul, Leipzig, German Democratic Rep.

[73] Assignee: VEB Polygraph Leipzig, Kombinat fuer Polygraphische Maschinen und Austruestungen, Leipzig, German Democratic Rep.

[21] Appl. No.: 753,473

[22] Filed: Dec. 22, 1976

[30] Foreign Application Priority Data

Dec. 30, 1975 [DD] German Democratic Rep. ... 190634

[51] Int. Cl.[2] ..... B65H 19/08; B65H 19/18

[52] U.S. Cl. ..... 156/504; 242/58.1

[58] Field of Search ..... 156/504; 242/58.1–58.4

[56] References Cited

U.S. PATENT DOCUMENTS

| | | | |
|---|---|---|---|
| 2,029,046 | 1/1936 | Wood | 242/58.3 |
| 3,015,454 | 1/1962 | Flannery | 242/58.2 |
| 3,391,877 | 7/1968 | Angell et al. | 242/58.3 |
| 3,516,617 | 6/1970 | Haner et al. | 156/504 |

*Primary Examiner*—Douglas J. Drummond
*Attorney, Agent, or Firm*—Michael J. Striker

[57] ABSTRACT

A web is being pulled off a supply roll nearing exhaustion. As the supply roll becomes exhausted, the web being pulled off is severed, and the trailing end of the severed web is glued to the periphery of a fresh web supply roll. Before the severing and gluing operation occurs, the peripheral speed of the fresh web supply roll must be brought up to coincidence with the travel speed of the web being pulled. An accelerator roller driven by a motor rolls upon the fresh supply roll, accelerating it up to speed. When the fresh roll reaches the predetermined speed, the severing and gluing unit is enabled for subsequent synchronized activation. The acceleration of the fresh roll is monitored indirectly by a transducer coupled to the accelerator roller. When the desired speed is reached, a time delay is allowed to elapse before the motor is shut off, causing the desired speed to be exceeded. As the fresh roll then decelerates it again reaches this speed. This second reaching of the desired speed during deceleration is detected, and the detection causes the severing and gluing unit to be enabled for subsequent activation.

7 Claims, 4 Drawing Figures

ARRANGEMENT FOR SHUTTING OFF THE DRIVE FOR A SUPPLY ROLL

Figure 1:
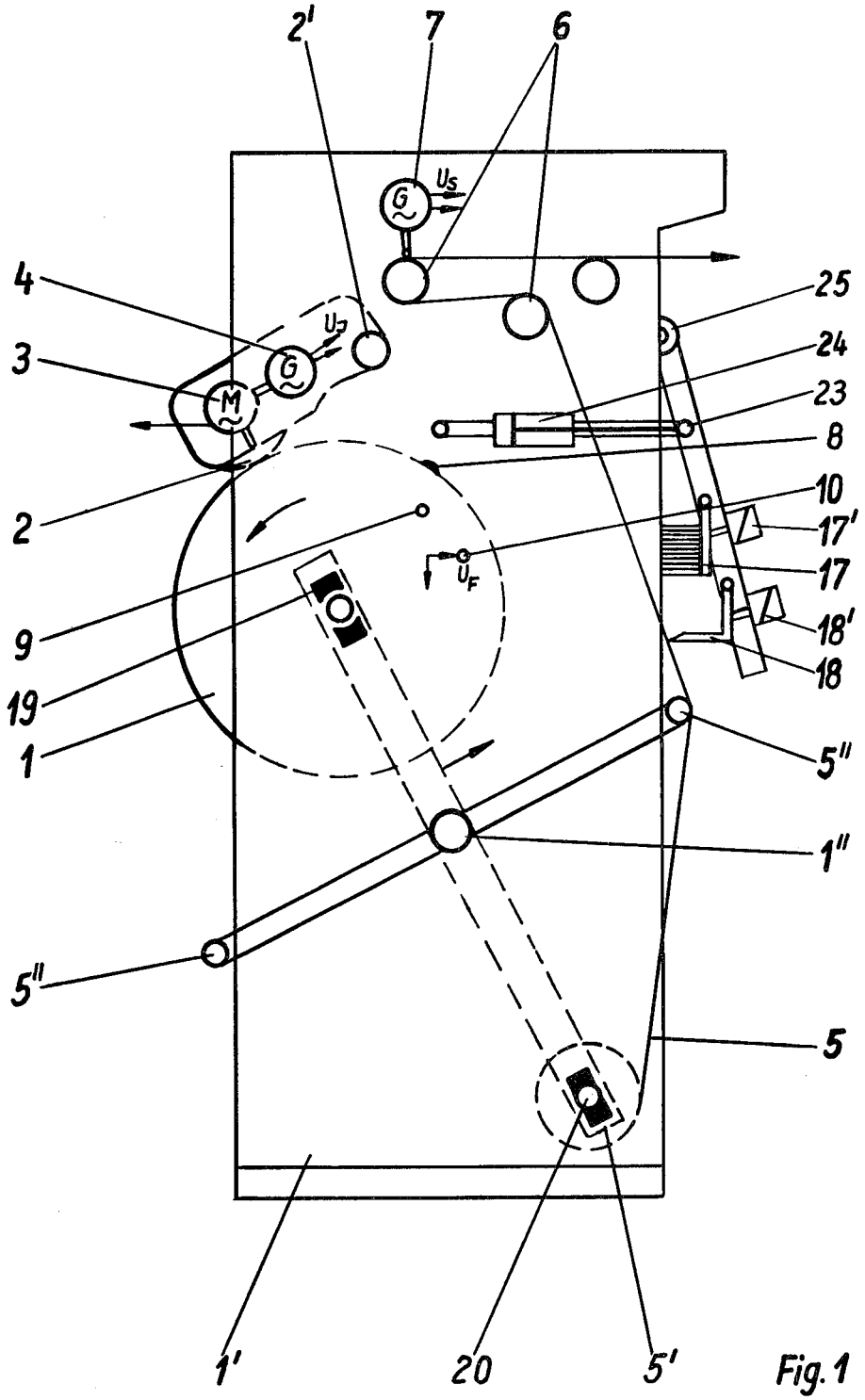

The invention relates to an arrangement for terminating the driving of a supply roll by an accelerating roller rolling upon the supply roll, the accelerating roller having arranged thereon a transducer for indicating its peripheral speed, the measured value supplied by the transducer being furnished to a comparator connected to the transducer output to detect coincidence of the peripheral speed of the supply roll with the travel speed of a web.

With known arrangements of this type, which find use in apparatuses for gluing webs together (autopasters), the signal generated by the comparator at speed coincidence is utilized to immediately shut off the drive for the accelerator roller, accordingly terminate further acceleration of the supply roll, and clear the way for the gluing-together operation, which latter is initiated within one supply roll rotation when the glued tip of the roll reaches a suitable position. Whereas when driving and accelerating a fresh supply roll by an expensive, so-called belt drive no speed difference can develop between the belt and the supply roll periphery even with out-of-round supply rolls — so that an exact speed coincidence at the turn-off moment is guaranteed — this is not the case when driving an out-of-round supply roll by means of an accelerator roller bearing upon and rolling on the supply roll. For various reasons, the force pressing the accelerator roller against the supply roll and exerted in direction toward the center of the supply roll cannot be of just any magnitude so as to assure that even with out-of-round supply rolls a continuous surface contact will be achieved between the two, which latter if a prerequisite for slip-free driving action.

Because supply rolls can be of different hardness, and because a scraping of the surface of the supply roll must absolutely be avoided in order to prevent the glued tip of the rolled-up fresh web from becoming detached from the supply roll, the force with which the rubber-coated accelerator roller presses against the periphery of the supply roll can be only relatively low.

Because, with out-of-round supply rolls, there develop on the accelerator roller radially acting forces and motions, the driven accelerator roller begins to be flung up by the out-of-round accelerator roller and for short time intervals loses its continual surface contact with the supply roll and briefly "runs free," i.e., not being loaded down by the supply roll and by virtue of its acceleration it begins to run faster than would correspond to the peripheral speed of the supply roll. Certainly, it is immediately braked down again, when it again contacts the slower turning supply roll; however, the termination of the acceleration of the accelerator roller usually occurs when the accelerator roller is running free, in the case of out-of-round supply rolls, because the accelerator roller and not the supply roll drives the transducer. For this reason, at the gluing-together moment, the peripheral speed of the supply roll is somewhat smaller than the web travel speed.

The difference is dependent upon the lack of roundness of the supply roll being used at the particular time; therefore, it is practically impossible to compensate for it. This difference between the peripheral speed of the supply roll and the web travel speed has the result that, at the glue-on moment, the web tension increases abruptly, the gluing-together location is subjected to considerable tension, and the entire gluing-together operation becomes unreliable. It is not always possible to assess in advance the lack of roundness of a supply roll and accordingly the difficulty to be expected during the gluing-together operation; therefore, high demands are placed upon fresh supply rolls to be glued-on, with respect to their roundness, and these cannot always be met or maintained during transport and storage. For this reason, use is usually made of considerably more expensive belt drives for accelerating the fresh supply roll and not the considerably less expensive and sturdier drives utilizing accelerator rollers.

It is the object of the invention to make the economic supply roll drives utilizing accelerator rollers practicable for out-of-round supply rolls, too.

Additionally, an object to be achieved is the provision of an arrangement which renders ineffectual the speed differences between the accelerator roller and the supply roll described above and unavoidable with out-of-round supply rolls, so that the speeds of the accelerator roller and supply roll will exactly correspond to the web travel speed at the time of clearing the way for the gluing-together operation. The arrangement should require only small additional expense and should be capable of use with existing autopasters of the type in which the fresh supply roll is driven by an accelerator roller without redesign or substantial structural modification. These objects are achieved with an arrangement for shutting off the drive for an accelerator roller which accelerates a supply roll up to web travel speed and is coupled with a peripheral speed transducer whose output signal is furnished to a comparator connected to the transducer output for comparison with a reference value dependent upon web travel speed; the comparator controls a turn-off arrangement for the drive, the turn-off arrangement being connected to the comparator output, and controls an enabling arrangement for the gluing-together operation — with this arrangement, these objects are achieved according to the invention by arranging between the comparator and the turn-off arrangement a time-delay arrangement and by associating the enabling arrangement with the comparator directly and in such a manner that the enabling arrangement is activatable by the comparator only after the activation of the turn-off arrangement by the time-delay arrangement.

The introduction of the time-delay arrangement between the comparator and the turn-off arrangement has the result that the drive for the supply roll is shut off not until a certain time after the output signal generated by the comparator in response to speed coincidence, so that the peripheral speed of the supply roll will now reliably be greater than the web travel speed at the turn-off moment. The supply roll and the drive means therefor will be automatically decelerated by virtue of friction, etc., and only in response to the next occurrence of speed coincidence is the enabling arrangement activated by the comparator.

Figure 2:
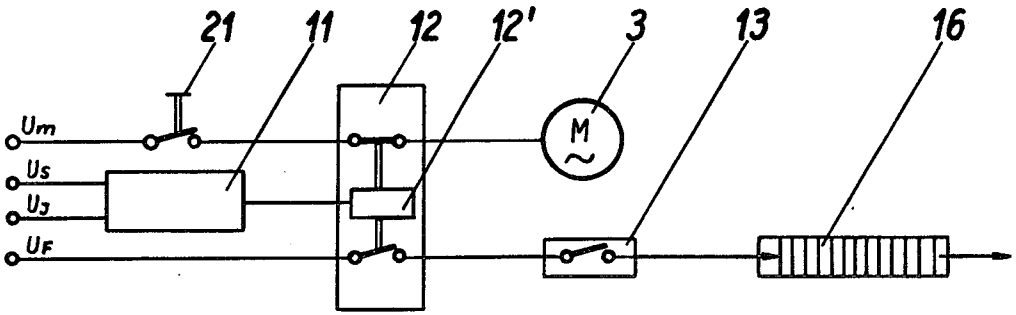
Prior Art Fig. 2
Figure 3:
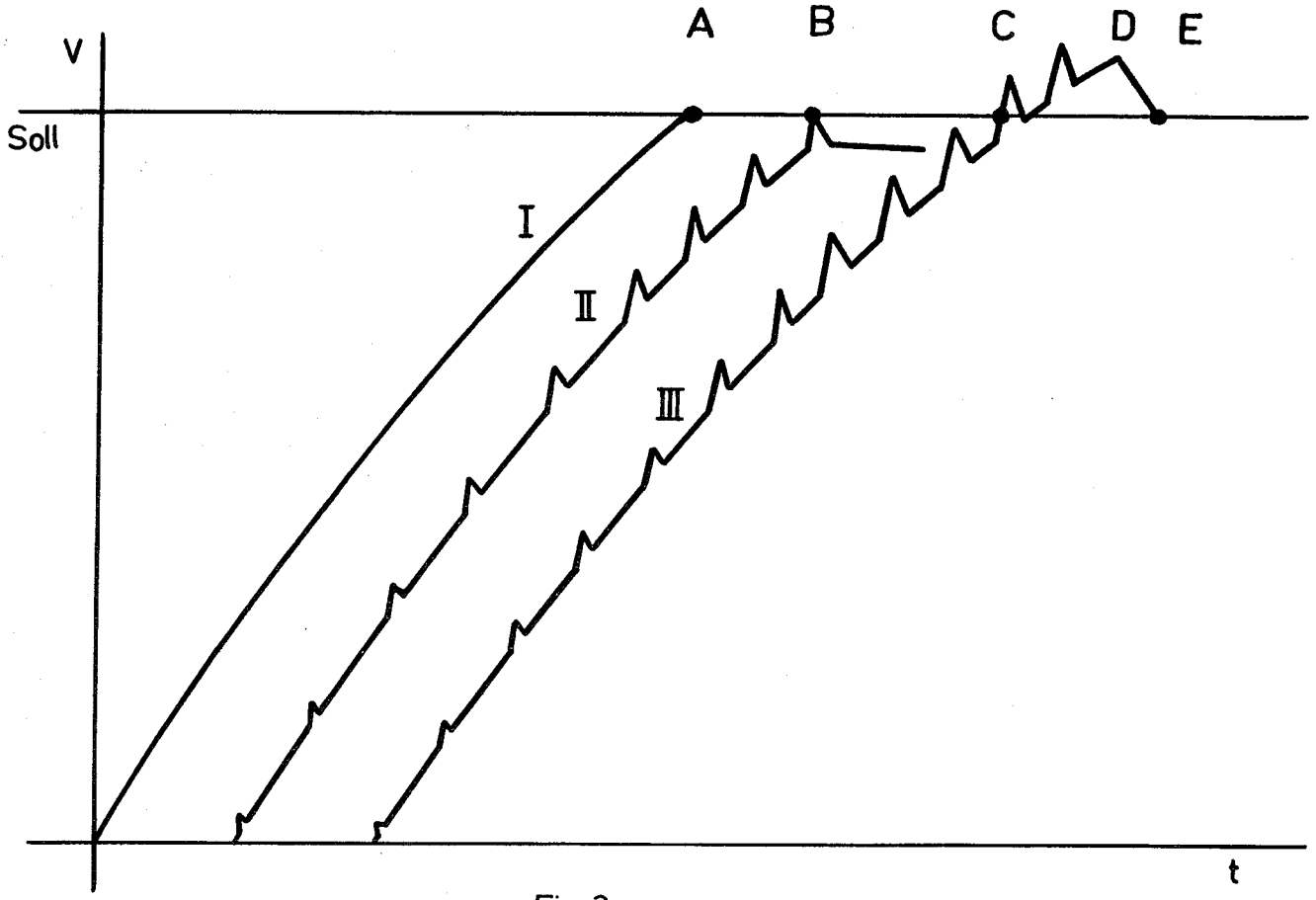

The invention is further explained with reference to the drawing, which depicts:

FIG. 1: a schematic illustration of an arrangement for driving supply roll by means of an accelerator roller;

FIG. 2: a block schematic of a prior art circuit arrangement for shutting off the drive for the accelerator roller;

FIG. 3: three time-versus-speed graphs for the acceleration of the roll; and

Figure 4:
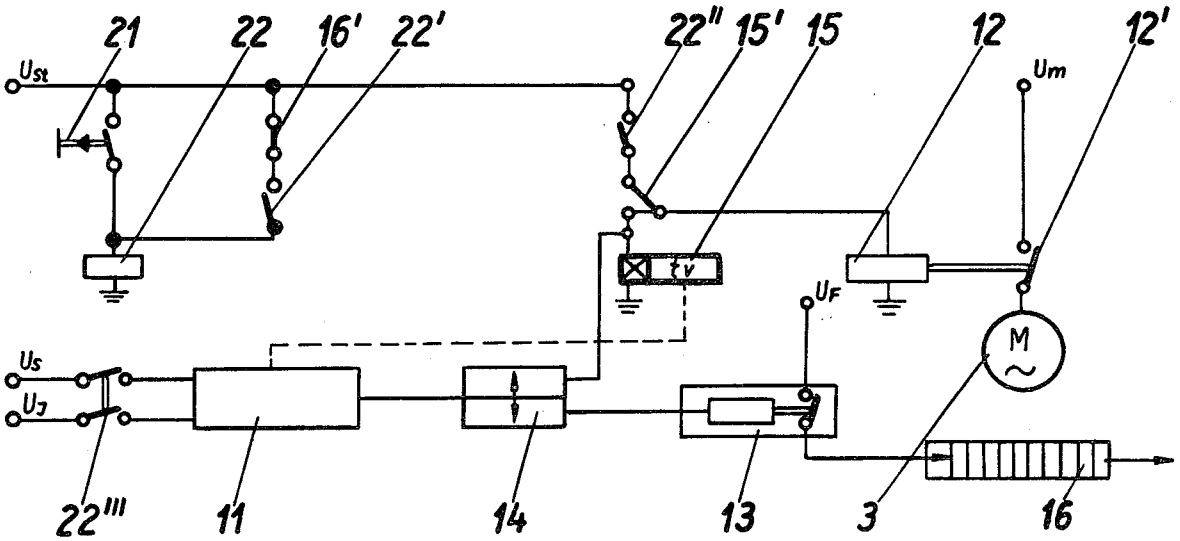

FIG. 4: a block schematic of the inventive circuit arrangement for shutting off the drive for the accelerator roller.

With the details not essential for an understanding of the invention omitted, FIG. 1 illustrates an arrangement for driving and accelerating a supply roll 1 by means of an accelerator roller 2, representative of the state of the art, and operating without problems if the supply rolls are perfectly round.

The accelerator roller 2 is driven by a drive 3, for example an accelerator motor, and is coupled with a transducer 4, for example a tachometer generator, for indicating the actual value of the peripheral speed of the accelerator roller 2. A web 5 is pulled, by means of a non-illustrated take-up device, over a pair of guide rollers 6 by means of which a tachometer generator for the peripheral speed of the two guide rollers 6 is driven. The peripheral speed of each guide roller corresponds to the web travel speed; it is accordingly the reference value for the peripheral speed of the supply roll 1. A glued portion 8 on the supply roll 1 corresponds in its position to a mark 9 on the side of the supply roll 1. The mark 9 is continually sensed by a detector 10 during rotation of supply roll 1; however, the detector pulse which initiates the gluing-together operation remains ineffectual until such time as the peripheral speed of the supply roll 1 exactly coincides with the speed of the web 5 and the acceleration of the supply roll 1 is terminated.

FIG. 2 depicts a block schematic of a prior art circuit arrangement for shutting off the drive for the supply roll 1 or of the accelerator roller 2. The reference-value voltage $U_S$ of the transducer 7 and the actual-value voltage $U_I$ of the transducer 4 are furnished to a comparator 11. If the two voltages and accordingly the two speeds correspond, then the comparator 11 furnishes a signal to a turn-off device 12, which shuts off the drive 3 (FIG. 1), and also to an enablement arrangement 13 which clears the way for the next pulse from the detector 10 (FIG. 1) to initiate the gluing-together operation.

FIG. 3 depicts a v-t diagram with three curves I, II and III shifted relative to one another with respect to time and corresponding to the actual-value voltage $U_I$ at the transducer 4 (FIG. 1). The horizontal line corresponds to the reference-value voltage of the transducer 7, which voltage is assumed to be constant.

Curve I shows the speed progression when accelerating a preferably round supply roll by means of an accelerator roller. The acceleration is terminated at point A, when the reference speed and the actual speed exactly coincide.

Curve II shows the speed progression when accelerating an out-of-round supply roll by means of an accelerator roller; the speed progression is proportional to the signal being generated by the transducer 4. Curves II and III exhibit over their entire extends upwardly pointing acceleration spikes; as the peripheral speed of the supply roll increases, the spacing of the spikes becomes progressively smaller and their amplitude becomes progressively greater. They have the following cause: The accelerator roller 2 (FIG. 1) bears upon the periphery of the supply roll 1 only relatively lightly; the roller 2 is flung up to a certain extent by the out-of round supply roll, so that its surface contact with the supply roll 1 is briefly lost. In this time interval, the drive 3 accelerates the accelerator roller 2 and accordingly the transducer 4 considerably more than when the accelerator roller 2 is loaded down by the supply roll 1; accordingly, there is intermittently applied to the comparator 11 (FIG. 2) a transducer output voltage not corresponding to the actual peripheral speed of the periphery of supply roll 1. If use is made of the arrangement shown in FIG. 2, then the voltage spike at point B effects a shutting off of the drive for the accelerator roller and enablement of the gluing-together operation, although the peripheral speed of the supply roll 1 is beneath the reference speed. If curve III, point C corresponds to point B of curve II; however, in the case of this voltage coincidence, the inventive arrangement described with reference to FIG. 4 is controlled via the known comparator 11. The signal furnished by the comparator 11 at point C (FIG. 3) is transmitted via a bistable multivibrator 14 to a time-delay device 15 which, as indicated by the broken line, is operative during the time-delay interval for preventing further signal generation by the comparator 11 until, after the time delay, the shut-off arrangement 12 for the drive 3 is activated. This moment in time is the point indicated by D in curve III of FIG. 3. The peripheral speed of the supply roll is greater than the web travel speed; its drive 3 is shut off; and the drive system (accelerator roller, drive) as well as the supply roll, due to frictional forces, begin to slow down. The accelerator roller does "jump" as before; however, because it is no longer subjected to drive forces, no spikes develop. At point E of curve III, the web travel speed and the peripheral speed again coincide; the comparator 11 furnishes a second signal, via the multivibrator 14 which changes state, to the enablement device 13; and the latter in the manner already described enables the gluing-together operation triggered by the detector 10 (FIG. 1).

Inventive features of the arrangement are, firstly, the time-delay arrangement which assures that the peripheral speed of the supply roll at the time its drive is shut off is greater than the web travel speed and, secondly, the evaluation of a second coincidence signal for enabling the gluing-together operation. The routineer will have no difficulty in implementing the invention, for example without a multivibrator and instead with one or two relays representing small additional expense relative to prior-art practice.

The two-armed levers for mounting the fresh supply roll 1 and the exhausted supply roll 5' are accommodated in frame walls 1' by means of a shaft 1''. Also mounted on shaft 1'' are the two-armed levers for the web guide rollers 5''. Additionally accommodated between the frame walls by means of a shaft 2' and corresponding mounting frames is the accelerator roller 2 with its drive 3.

A pair of guide rollers 6 completes the web guiding elements. The elements for gluing the web 5 onto the supply roll 1 include a brush unit 17 with the actuating magnet 17' as well as the cutting unit 18 with the associated actuating magnet 18'. Both units are mounted on a common brush- and knife-pivoting arm 23 which can be swung about a pivot point 25 by an operating cylinder 24. Symbolically indicated are the supply roll brakes for the fresh supply roll 1, designated by 19, and for the exhausted supply roll 5', designated by 20. Brakes of this type are in general known and have the greatest variety of constructions. However, they always operate in cooperation with the web-tension-control and -regulating elements.

Whereas the exhausted supply roll 5' in the illustration of FIG. 1 is braked to produce a uniform web tension, it is unbraked during the phase in which the fresh supply roll 1 is accelerated. Immediately after the cutting operation, as described below, the braking of the exhausted supply roll 5' is terminated and at the same moment and for the same purpose the fresh supply roll 1 is braked.

FIG. 2 (prior art) shows the switch 21 in the motor current path $U_m$; by means of switch 21 the drive 3 is furnished with its supply voltage $U_m$. Connected to the output of the comparator 11 is a changeover relay 12' which is mechanically connected with the contacts of the turn-off arrangement 12. As soon as the comparator 11 signals equality (reaching of point A or B in FIG. 3), the upper contact of turn-off arrangement 12 is opened and the lower contact is closed. Simultaneously with the stopping of drive 3, the enablement arrangement 12 is closed, so that the next sensing of mark 9 by detector 10 will effect the first shift of a shift register 16 and in known manner the autopaster control of the actuating magnet 16' for initiating the gluing-together operation. The next time mark 9 passes detector 10, by means of the enablement arrangement 13 and the next shift of the shift register 16, the actuating magnet 18' responds, and accordingly the cutting arrangement 18 is activated to sever the web 5 from the exhausted supply roll 5'. At the same moment, the braking action is switched over from the exhausted supply roll 5' to the fresh supply roll 1 via the associated brakes 20 and 19.

In the same manner, upon the next-following shift of the shift register, the operating cylinder 24 is activated, and accordingly the brush and knife lever 23 is brought into a position permitting the swinging of the autopaster lever, so that the fresh supply roll 1 will be located in the lower position or in a position in which the next fresh supply roll can be inserted in place of the exhausted supply roll 5'.

Whereas in FIG. 2 (prior art) there is illustrated the circuit exhibiting the disadvantages of the prior art, there is depicted in FIG. 4 the main part of the inventive arrangement by means of which the curve III of FIG. 3 can be realized.

FIG. 4 has a control current path to which the voltage $U_{st}$ is applied. A switch 21, again activatable manually or else by means of an automatic exhausted supply roll adjustment, activates the auxiliary relay 22 which, during the time of the gluing operation is kept by means of the contact 22' holding condition. Accordingly, simultaneously the shut-off arrangement 12 is activated by means of the contact 22'', so that the drive voltage $U_m$ via the switch 12' again sets the drive 3 into operation.

Simultaneously with the switching of contacts 22' and 22'', also the switch 22''' is activated, so that the comparator 11 and the bistable multivibrator 14 can become activated.

In the manner described, when point C is reached by means of the accelerator roller 2, the generated signal is transmitted via the bistable multivibrator 14 to a time-delay device 15. During the time-delay interval, the signal transmission is initially blocked, i.e., delayed in time, so that the contact 15' will switch over only after the elapsed interval $t_v$; as a result, the shut-off arrangement 12 is then eventually caused to shut off the drive 3 (point D in FIG. 3). After the shut-off of the drive, the supply roll 1 is undriven, and its peripheral speed decreases to a speed corresponding to point E in FIG. 3. At point E, the web travel speed of web 5 and the peripheral speed of the supply roll 1 coincide absolutely. (The accelerator roller 2 is moved by the supply roll 1; accordingly, it jumps without acceleration surges.)

The comparator 11 furnishes a second signal to the enablement device 13 via the multivibrator 14, which changes state; the enablement device 13 in the manner already described permits the gluing-together operation triggered by the detector 10, shifts the shift register 16 and accordingly initiates the autopaster operations already described in connection with FIG. 2. (prior art) In addition to the operations described in connection with FIG. 2, all that additionally occurs, as the last operating step of the shift 16, is the opening of contact 16' in the control current path, so that as a result the entire autopaster operation is completed.

I claim:

1. In an autopaster of the type comprising web transport means for pulling web off a supply roll so that the supply roll eventually nears exhaustion, holding means holding a fresh supply roll comprised of a web whose accessible end is to be glued to the web of the supply roll which is nearing exhaustion, severing and gluing means operative when activated for severing the web being pulled off the exhausted supply roll and gluing to the latter the accessible end of the web on the fresh supply roll so that web transport can continue, accelerator means operative when a severing and gluing operation is to be performed for first accelerating the fresh supply roll up to a predetermined peripheral speed at least approximately equal to the transport speed of the web being pulled off the expiring supply roll, the accelerator means including at least one accelerator roller mounted to bear upon the peripheral surface of the fresh supply roll, and a motor driving the accelerator roller to cause the latter to rotate and thereby accelerate the fresh supply roll, speed-measuring means operative for measuring the speed of the fresh supply roll indirectly by measuring the speed of operation of the accelerating means and for generating a corresponding speed signal whereby, if contact is lost between the accelerator roller and the fresh supply roll due to lack of roundness of the fresh supply roll surface, the accelerator means will temporarily operate at a speed higher than that corresponding to the speed of the fresh supply roll and the speed signal will falsely indicate a fresh-supply-roll speed higher than the true speed of the fresh supply roll, in combination therewith, a control system operative for causing the fresh supply roll to be brought to the predetermined speed, the control system comprising control means receiving the speed signal and in dependence thereon operative for causing the accelerator means to accelerate the fresh supply roll to a speed in excess of the predetermined speed, then operative for deactivating the accelerator means so that acceleration of the fresh supply roll is discontinued and the fresh supply roll begins to decelerate, then operative during such deceleration for determining when the speed of the fresh supply roll has dropped down to the predetermined speed, and in response to that determination operative for generating an enablement signal enabling activation of the severing and gluing means.

2. In an autopaster as defined in claim 1, the control means comprising comparator means receiving the speed signal and operative for producing a first comparator output signal when during the acceleration of the fresh supply roll the speed signal corresponds to the predetermined speed and a second comparator output signal when during the deceleration of the fresh supply roll and speed signal again corresponds to the predetermined speed, time-delay means connected to the comparator means and to the accelerator means and operative in response to the first comparator output signal for deactivating the accelerator means but only after the elapse of a predetermined time interval following the first comparator output signal, whereby to assure that acceleration of the fresh supply roll continues up to a speed in excess of the predetermined speed, and enabling means responsive to the second comparator output signal but not to the first comparator output signal, and operative in response to the second comparator output signal for enabling the severing and gluing means for operation.

3. In an apparatus comprised of a driving means activatable for accelerating a driven means up to a predetermined speed and a device which is to be activated when the driven means reaches the predetermined speed, in combination, speed-sensing means operative for sensing the speed of the driving means and generating a corresponding speed signal; and control means receiving the speed signal, operative for deactivating the driving means when during acceleration of the driven means the speed signal indicates a speed higher than the predetermined speed so that the driven means will cease to be driven and begin to decelerate, and operative for detecting when during such deceleration the speed signal indicates the predetermined speed and in response to such detection activating said device.

4. The apparatus defined in claim 3, the driven means comprising a rotatably mounted cylindrical member, the driving means comprising an accelerator roller, means mounting the accelerator roller to bear upon the peripheral surface of the cylindrical member and a motor driving the accelerator roller to cause the latter to rotate the cylindrical member.

5. The apparatus defined in claim 3, the control means comprising a comparator having one input connected to the speed-sensing means to receive the speed signal and having an other input, means for applying to said other input a reference signal corresponding to the predetermined speed, time-delay means, deactivating means connected to the output of the comparator through the intermediary of the time-delay means and operative in response to a delayed output signal from the comparator for deactivating the driving means, said device which is to be activated when the driven means reaches the predetermined speed being responsive to an output signal from the comparator, and means for transmitting to said device the comparator output signal produced during said deceleration without transmitting thereto the comparator output signal produced during said acceleration.

6. The apparatus defined in claim 3, the apparatus being an autopaster comprising web transport means for pulling a web off a supply roll so that the supply roll eventually nears exhaustion, the driven means comprising a fresh supply of web rolled up to constitute a fresh supply roll, the driving means comprising an accelerator roller, means mounting the accelerator roller to bear upon the peripheral surface of the fresh supply roll and a motor driving the accelerator roller to cause the latter to rotate the fresh supply roll, said device to be activated being means operative when activated for severing the web being pulled off the exhausted supply roll and gluing the trailing end of the severed portion of web to the fresh supply roll so that pull-off of web can continue from the fresh supply roll, the control means including means for sensing the speed of the web being pulled off the exhausted supply roll and utilizing the web speed as said predetermined speed.

7. The apparatus defined in claim 6, the control means comprising a comparator having one input connected to the speed-sensing means to receive the speed signal and having an other input, means for applying to said other input a reference signal corresponding to the web speed, time-delay means, deactivating means connected to the output of the comparator through the intermediary of the time-delay means and operative in response to a delayed means and operative in response to a delayed output signal from the comparator for deactivating the motor, said gluing and severing means being provided with enabling means operative when activated for enabling the severing and gluing means to become activated, and means for transmitting to the enabling means the comparator output signal produced during said deceleration without transmitting thereto the comparator output signal produced during said acceleration.

* * * * *